US005274348A

United States Patent [19]

Vernier et al.

[11] Patent Number: 5,274,348

[45] Date of Patent: Dec. 28, 1993

[54] ELECTROMAGNETIC RELAY

[75] Inventors: Richard A. Vernier, Princeton; Thomas H. Vaughn, Evansville, both of Ind.

[73] Assignee: Potter & Brumfield, Inc., Princeton, Ind.

[21] Appl. No.: 837,798

[22] Filed: Feb. 19, 1992

[51] Int. Cl.[5] ..... H01H 51/22

[52] U.S. Cl. ..... 335/78; 335/160

[58] Field of Search ..... 335/78-86, 335/129.3, 106, 159-162

[56] References Cited

U.S. PATENT DOCUMENTS

| | | | |
|---|---|---|---|
| 2,505,849 | 5/1950 | Bevis et al. . | |
| 2,611,012 | 9/1952 | Baker . | |
| 2,735,968 | 2/1956 | Bogue . | |
| 2,819,364 | 1/1958 | Jaidinger . | |
| 3,218,410 | 11/1965 | Reber . | |
| 3,292,120 | 12/1966 | Malmborg . | |
| 3,581,157 | 5/1971 | Hall . | |
| 3,815,060 | 6/1974 | Turnball . | |
| 3,964,005 | 6/1976 | Schantz . | |
| 4,529,953 | 7/1985 | Myers . | |
| 4,535,311 | 8/1985 | Okihara et al. . | |
| 4,686,500 | 8/1987 | Ide et al. . | |
| 4,816,794 | 3/1989 | Nagao et al. | 335/136 |
| 4,959,627 | 9/1990 | Iizumi et al. | 335/106 |

FOREIGN PATENT DOCUMENTS

| | | |
|---|---|---|
| D19754 | 2/1955 | Fed. Rep. of Germany . |
| 0924873 | 3/1955 | Fed. Rep. of Germany . |
| 1203390 | 10/1965 | Fed. Rep. of Germany . |
| 1539830 | 12/1969 | Fed. Rep. of Germany . |
| 1564803 | 5/1971 | Fed. Rep. of Germany . |
| 2210497 | 9/1972 | Fed. Rep. of Germany . |
| 3834283 | 4/1990 | Fed. Rep. of Germany . |
| 56-134434 | 10/1981 | Japan . |

OTHER PUBLICATIONS

"Design of a New Twin-Relay and its Performance for Automotive Applications" by T. Ide et al.; Proceedings of the 37th Annual National Relay Conference, Apr. 17-19, 1989, pp. i to vii and 6-0 to 6-9.

*Primary Examiner*—Lincoln Donovan

*Attorney, Agent, or Firm*—Joseph S. Codispoti

[57] ABSTRACT

An electromagnetic relay to be used in applications such as DC motor reversing. The relay consists of two electromagnetic devices in a single enclosure with contacts configured in a so-called "H-bridge" circuit. Each of the devices has a movable contact element, while both devices have a common pair of normally closed and normally open stationary contact elements. Both electromagnetic devices have coil bobbins which are preferably identical in shape and are locked together by means of the common stationary contact elements without a need of additional fastening means. In this manner, the number of parts is minimized and the amount of adjustment required is reduced.

14 Claims, 5 Drawing Sheets

ELECTROMAGNETIC RELAY

TECHNICAL FIELD

The invention relates to an electromagnetic relay. More particularly, the invention relates to a DC motor reversing relay including two relay systems with contacts configured in an "H-bridge" circuit. Relays of this type are commonly used in automotive applications, e.g. automotive power windows, power door locks, electric antenna motors, seat positioners and motorized sun roofs.

BACKGROUND OF THE INVENTION

A motor reversing relay is already known from U.S. Pat. No. 4,816,794. In this known relay, two electromagnetic devices are arranged side by side with the common pair of fixed contact terminals being arranged on one side of the double relay. Thus, the fixed terminals have to extend along both these systems and, accordingly, the terminals have a double length of a single relay unit. Accordingly, the contact space is large compared with the whole relay volume. Further, the two relay units have bobbins with different shapes requiring different die molds and manufacturing steps. In addition, there is a problem of controlling the operational relationship between the two relay units.

Another motor reversing relay is described in U.S. Pat. No. 4,959,627 and comprises a flat base, wherein two electromagnetic relay blocks and at least two stationary contact elements are fixed on the base separately. The contact positions in this relay are fully adjustable.

It is, therefore, an object of the present invention to provide an electromagnetic motor reversing relay which allows a space reduction for the common contact system and accordingly for the total volume of the relay.

It is another object of the present invention to provide such an electromagnetic relay which allows minimizing the number of parts and reducing the manufacturing, tooling and assembling costs.

It is still another object of the present invention to provide such an electromagnetic relay wherein the two electromagnetic devices can be fixed together without providing additional fixing parts and without the need of adjusting the location of the stationary contact elements.

SUMMARY OF THE INVENTION

According to the present invention, there is provided an electromagnetic relay comprising (a) a pair of electromagnetic devices each of which comprises: a bobbin carrying a coil and having first and second flanges at both ends thereof; a core, a frame and an armature mounted rockably (i.e., pivotally) on said frame and having a movable end; and a movable contact element actuated by said armature and having a contact end extending beyond said movable end of said armature, said pair of bobbins being juxtaposed so as to define a boundary area therebetween and being fixed together by interlocking means engaging at least their respective first flanges; and (b) a pair of normally open and normally closed stationary contact elements arranged in said boundary area and opposing each other to form a contact gap therebetween, said movable ends of said armatures opposing each other and said contact ends of said movable contact elements extending side by side in opposing directions into said contact gap; and each of said contact ends being reciprocated between said normally closed and said normally open stationary contact elements by activating and deactivating said electromagnetic devices.

In a relay provided by the present invention, the common stationary contact elements are arranged in a boundary area between the two bobbins. In this manner, the total contacting space corresponds only to the width of one electromagnetic device. Further, the two bobbins are fixed together in said boundary area, either by interlocking means provided on the flanges of the bobbins themselves or by means of the stationary contact elements engaging the flanges of both bobbins. In this manner, the number of parts is minimized.

The stationary contact elements may be designed to serve to locate and retain the bobbins in the desired position. This function can be accomplished through barb-like projections and/or retention spring features engaging corresponding features of the bobbins.

In addition, both bobbins may have identical shapes for allowing reduced tooling costs.

Advantageously, a relay provided by the present invention configures the contact elements to have a tight fit in respective slots in the bobbins so as to reduce the amount of vertical (i.e. parallel to the core) misalignment possible between the two devices. The alignment is further assured by a deliberate interference provided between the gripping means of the stationary contact elements and corresponding features of the opposite bobbins locked together therewith. In addition, close tolerances can be maintained in the molded bobbins to assure consistent contact gaps and operational relationships of the contacts to the respective bobbin.

Further, the arrangement of the pair of stationary contact elements in the boundary area between the pair of bobbins (and the pair of electromagnetic devices) facilitate rigid joining of the pair of devices and permit the usage of identically shaped bobbins.

BRIEF DESCRIPTION OF THE DRAWINGS

For a better understanding of the invention, reference is made to the following description of an exemplary embodiment thereof, and to the accompany drawings, wherein.

DETAILED DESCRIPTION

Figure 1:
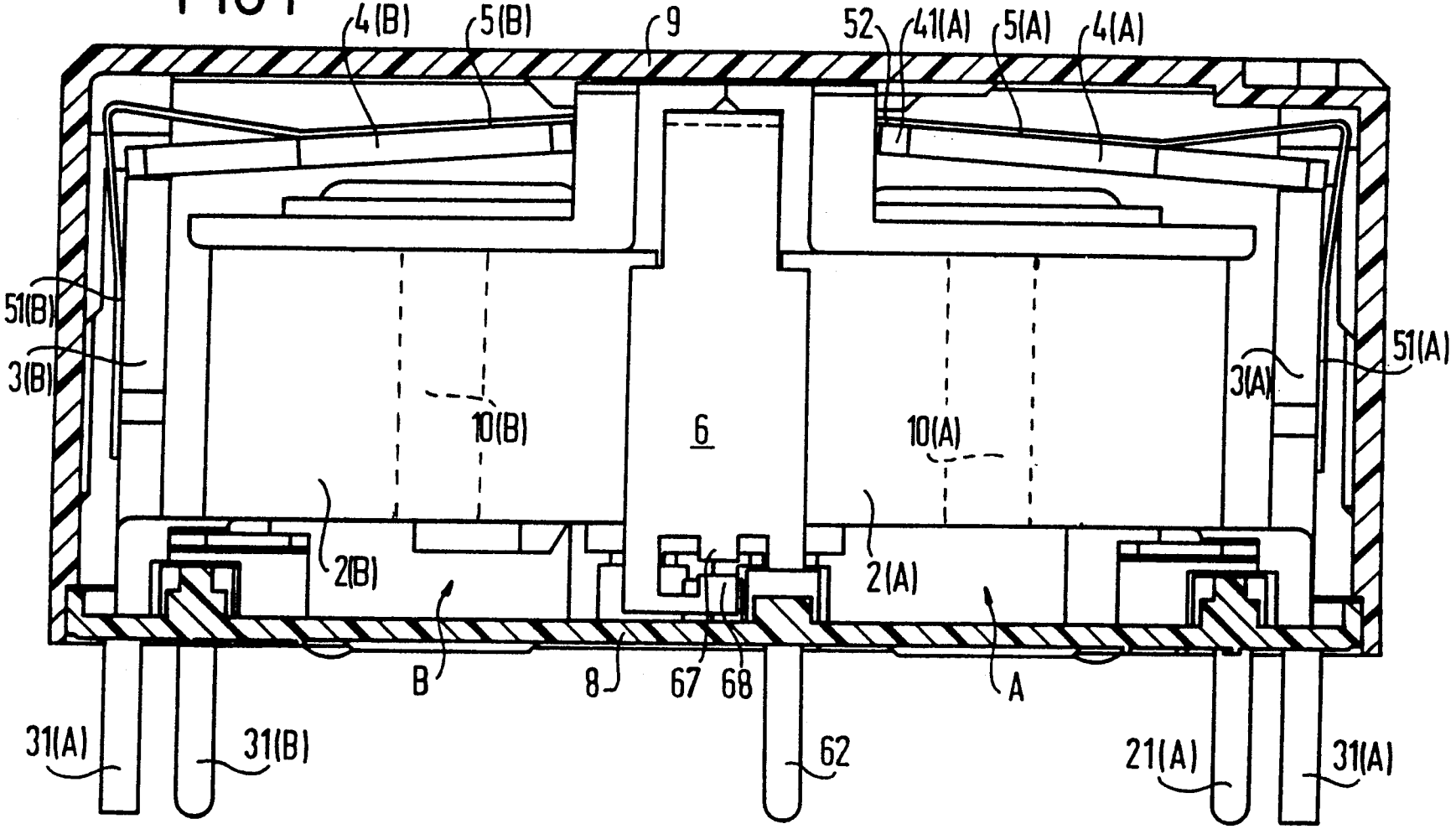
FIG. 1 is a side elevational view of an electromagnetic relay constructed in accordance with the present invention.
Figure 2:
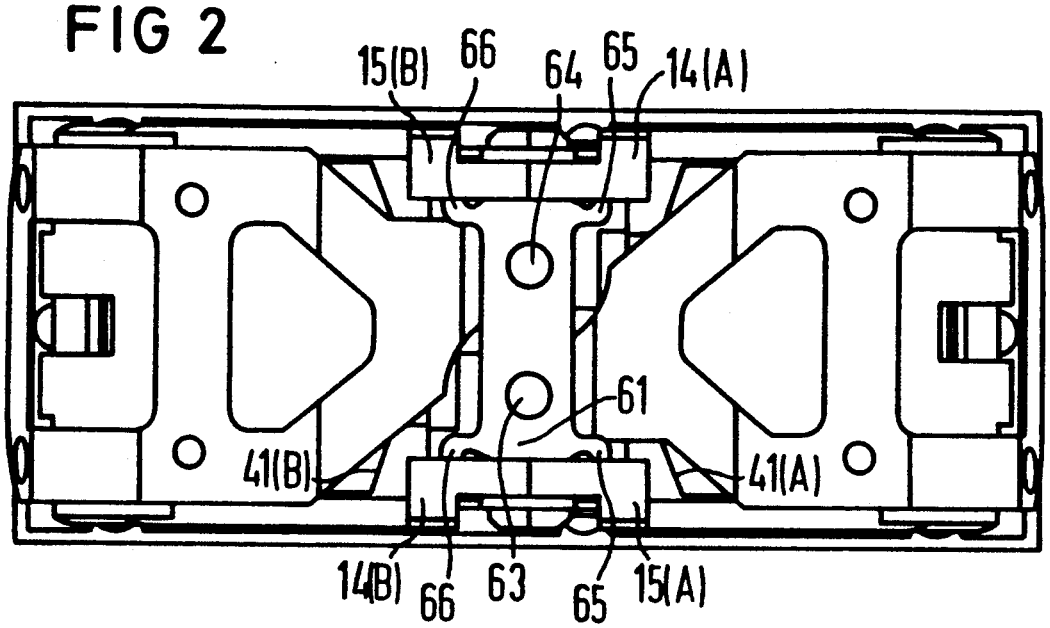
FIG. 2 is a top view of the relay of FIG. 1 with a removed cover.
Figure 3:
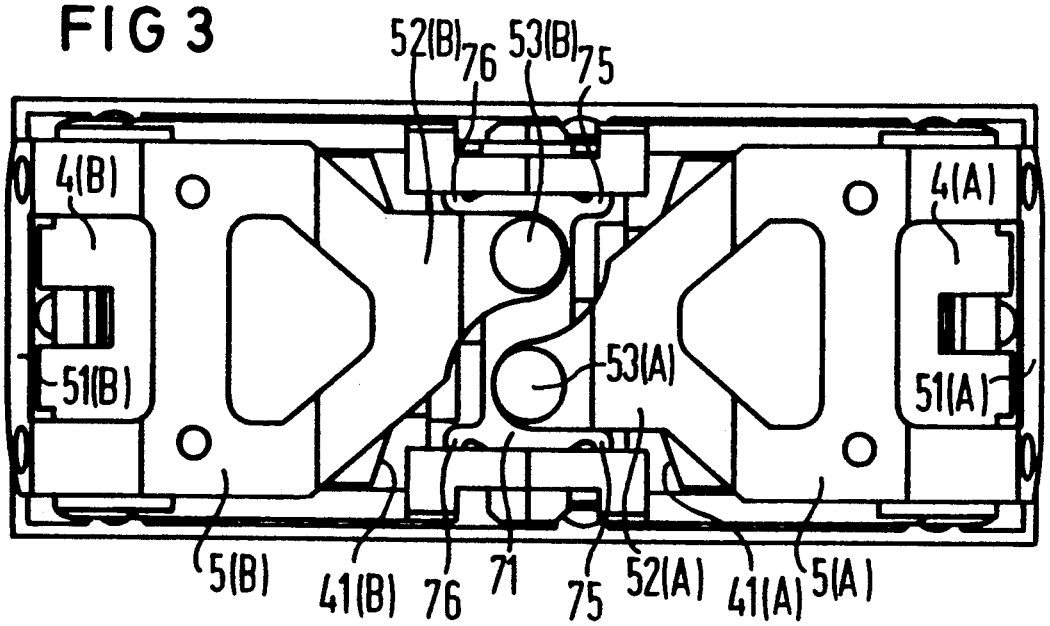
FIG. 3 is a top view of the relay of FIG. 2 with a removed normally closed stationary contact element.

FIGS. 1, 2 and 3 show an electromagnetic relay constructed in accordance with the present invention. The electromagnetic relay has two electromagnetic units or devices A and B of identical configuration which are joined together symmetrically. Thus, for ease of understanding the description and drawings, identical parts in the two electromagnetic devices are identified herein by the same reference numeral and, where necessary, with the respective notation (A) or (B).

Figure 4:
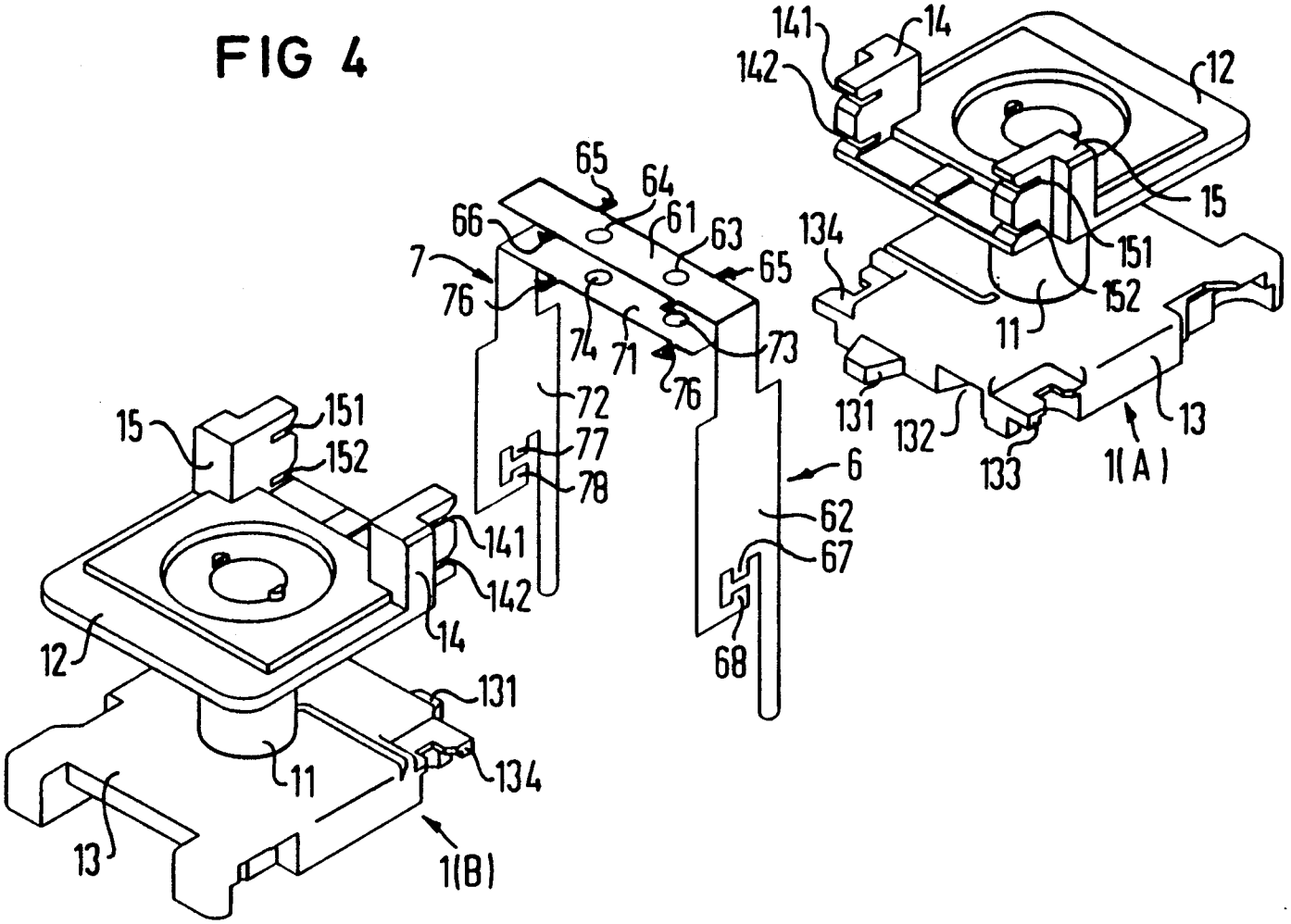
FIG. 4 is a perspective view of two bobbins and a pair of normally open and normally closed stationary contact elements before assembling.

Details of the bobbins and the stationary contact elements of the relay can be seen from FIG. 4. Each electromagnetic device has a bobbin 1 including a tube-like coil former 11, a first flange 12 at the upper end and a second flange 13 at the lower end thereof.

The bobbin 1 is provided with a coil 2, further with a core 10, a frame 3, an armature 4 which is mounted rockably (i.e. pivotally) on the end of the frame 3, and a contact spring 5. The contact spring 5 is fixed to the armature 4 and has a rear end 51 which is fixed to the frame 3; so the contact spring serves also for holding and retaining the armature. The frame 3 is provided with a terminal 31 for the contact spring, and the coil 2 is provided in usual manner with a pair of coil terminals 21.

As shown in FIG. 3, each contact spring has a contact end 52 extending beyond a movable end 41 of the armature 4 which contact end is asymmetrical with respect to a central line of the armature or a central plane of the electromagnetic device. On the contact end 52 of each contact spring 5 a movable contact 53 is fixed.

A pair of stationary contact elements, a normally closed stationary contact element 6 and a normally open stationary contact element 7, are common to both electromagnetic devices. The normally closed stationary element 6 has a horizontal contact arm 61 and a vertical terminal arm 62 and the normally open contact element 7 has a horizontal contact arm 71 and a vertical terminal arm 72. On the contact arm 61 two normally closed contacts 63 and 64 are fixed and on the contact arm 71 two normally open contacts 73 and 74 are fixed. Further, the contact arm 61 has barbs 65 on one side and barbs 66 on the other side, while the contact arm 71 has barbs 75 on one side and barbs 76 on the other side.

For receiving the contact arms 61 and 62, each of the first flanges 12 of the bobbins 1 has two vertical projections 14 and 15. In the first projection 14 a first groove 141 and a second groove 142 are provided, while in the second projection 15 a first groove 151 and a second groove 152 are formed. Each of these first and second grooves has a depth which is about one half of the width of the contact arms 61 and 71.

For assembling the relay, the electromagnetic devices A and B are connected by pressing the first flanges 12 and the second flanges 13 of both the bobbins 1 (A) and 1 (B) against each other and fastening the stationary contact arms 61 and 71 therebetween. In particular, the contact arm 61 is fitted into the first grooves or slots 141 and 151 of both the bobbins 1 (A) and 1 (B), and the contact arm 71 is fitted into the second grooves 142 and 152 of both the bobbins. By designing the arms to have a tight fit in the respective slots in the bobbin, the amount of vertical (i.e. parallel to the core axis) misalignment possible between the two devices is reduced.

Figure 7:
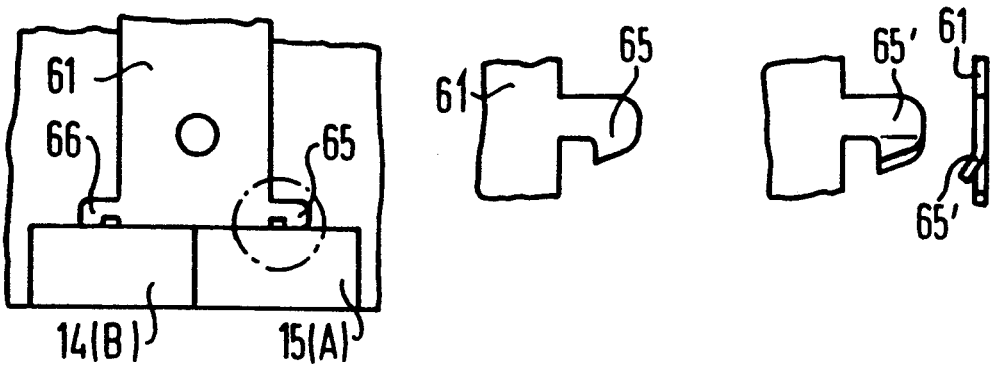
FIG. 7 is a top view of a detail of the relay of FIG. 2 illustrating a normally closed terminal captured by the two bobbins showing retention barbs and enlarged details of the retention barbs showing a formed and an unformed option in different views.

To prevent the two bobbins from separating at the top, the barbs 65, 66, 75 and 76 are designed to have an interference with the corresponding projection 14 or 15 of the respective bobbin. As shown in FIGS. 2 and 3 and in greater detail in FIG. 7, the barbs bite into the side wall of the corresponding projection 14 or 15, respectively. The sharp inner corners of the barbs catch against the bobbin if withdrawal is attempted. Radii on the leading edges facilitate seating the arms into the plastic bobbin 1. The barbs 65, 66, 75 and 76 may optionally have a small twist to them. This option is shown in FIG. 7 (right detail enlargement) in two different views.

By adding the twist, the barbs can be induced to rotate during insertion. This translates the displacement required as a result of the part interference into an action which twists the barbs rather than trying to bend them backwards. This lessens the tendency of the assembly operation to damage the arms and the bobbins by producing a lower spring rate than that associated with bending the metal in a direction at right angles to the thickness dimension. By producing the rotation over a portion of the length of the barb rather than just at the intersection of the barb and the arm, the stress concentration in the arm can be reduced.

For aligning the second flanges 13 of the bobbins aligning tabs 131 are optionally provided which fit into recesses 132 of the opposing bobbin, respectively. Further, near the boundary area between the two bobbins, a post 133 is formed on one peripheral side and also a post 134 is formed on the opposing peripheral side of the flange 13. Further, the terminal arm 62 has a grip feature including free cut retention spring lips 67 and 68, while the terminal arm 72 has corresponding retention spring lips 77 and 78. After assembling the two bobbins 1 (A) and 2 (B) by inserting the contact arms 61 and 71 into the respective grooves 141, 151 and 142, 152 of both the bobbins, the terminal arms 62 and 72 are bent over the opposing lateral gaps between the two bobbins. The retention spring lips 67 and 68 are pushed over the posts 133 and 134 of the two bobbins at one lateral side, while the retention spring lips 77 and 78 are pushed over the opposing posts 133 and 134. Since the retention spring lips interfere with the posts 133 and 134 the opposite flanges 13 of the two bobbins are locked together and alignment of the two bobbins is further assured.

Figure 5:
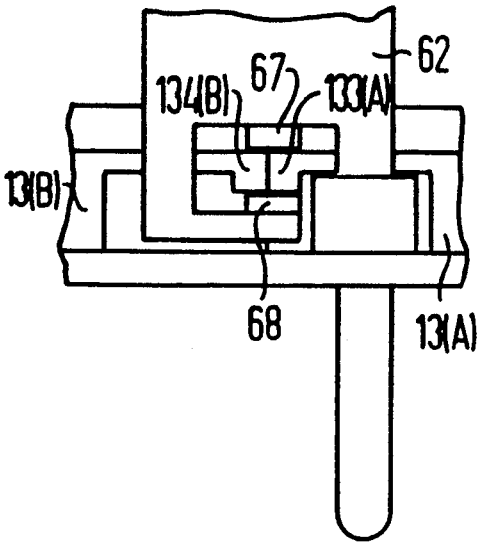
FIG. 5 is a side view of a detail of the relay of FIG. 1 illustrating the connection of two second bobbin flanges by means of two stationary contact elements.
Figure 6:
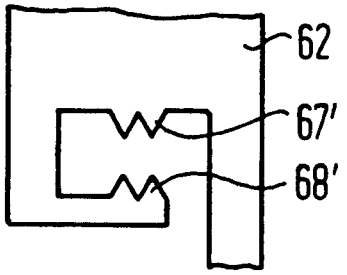
FIG. 6 is an enlarged detail of an alternate stationary terminal grip feature.

The grip feature is shown in detail in FIG. 5 with an enlarged side view. FIG. 6 shows the retention grip feature of a broken detail of the terminal arm 62 alone with a slight modification. In this modified embodiment, retention spring lips 67' and 68' are shown to be serrated for assisting insertion of the spring lips over the respective posts 133 and 134.

As shown in FIGS. 1 to 3, the relay structure is mounted on a base 8 and enclosed in a cover 9. The package is then sealed with an adhesive in a conventional manner, for example, according to a method described in U.S. Pat. No. 4,810,831.

Figure 8:
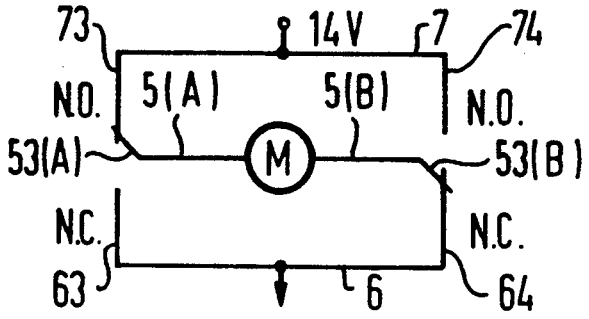
FIGS. 8, 9 and 10 are different contact configurations for a motor reversing relay constructed in accordance with the present invention.
Figure 9:
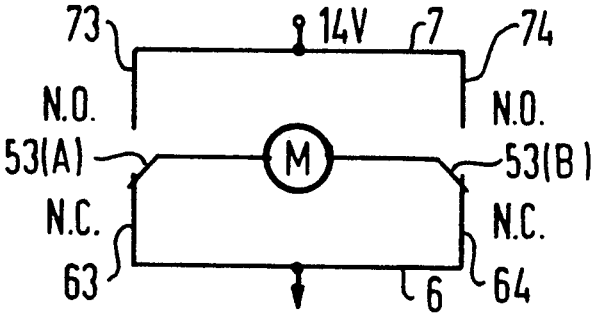
Figure 10:
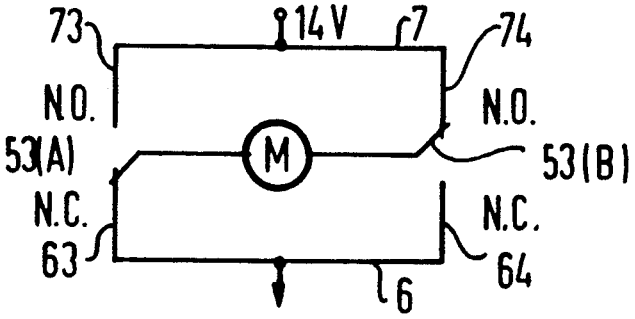

FIGS. 8, 9 and 10 show different contact configurations for reversed controlling a motor M. Normally closed and normally open contacts 63, 64 and 73, 74, respectively, are connected in common on the stationary contact arms 61 and 71 and the movable contacts 53 (A) and 53 (B) transfer between them in the manner shown in FIGS. 8 to 10. It is assumed that the normally closed contact element 6 is connected to ground, while the normally open contact element 7 is connected to a DC voltage, e.g. 14 V.

Energizing coil 2 (A) attracts the movable contact 53 (A) and produces the circuit shown in FIG. 8 (motor running forward). Energizing coil 2 (B) attracts the movable contact 53 (B) and results in the circuit as shown in FIG. 10 (motor running reverse).

When neither coil is energized the result is the circuit of FIG. 9. This configuration provides a low impedance path for the current generated by the motor load when either of coils 2 (A) or 2 (B) are turned off. This action provides a result which is commonly termed "dynamic braking" and serves to bring the motor to a quick stop.

The embodiments described herein are merely illustrative of the principles of the present invention. Various modifications may be made thereto by person ordinarily skilled in the art, without departing from the scope or spirit of the invention.

What is claimed is:

1. An electromagnetic relay, comprising:

(a) a pair of electromagnetic devices each of which comprises:

a bobbin carrying a coil and having first and second flanges at both ends thereof;

a core, a frame and an armature mounted rockably on said frame and having a movable end; and a movable contact element actuated by said armature and having a contact end extending beyond said movable end of said armature, said pair of bobbins being juxtaposed so as to define a boundary area therebetween and being fixed together by interlocking means engaging at least their respective first flanges; and (b) a pair of normally open and normally closed stationary contact elements arranged in said boundary area and opposing each other to form a contact gap therebetween, said movable ends of said armatures opposing each other and said contact ends of said movable contact elements extending side by side in opposing directions into said contact gap; and each of said contact ends being reciprocated between said normally closed and said normally open stationary contact elements by activating and deactivating said electromagnetic devices.

2. The electromagnetic relay of claim 1, wherein each of said bobbins has first and second grooves parallel to each other, each first groove of a first bobbin facing and aligning a first groove of a second bobbin, said normally open stationary contact element being fitted into said first grooves of both bobbins, respectively, and said normally closed stationary contact element being fitted into said second grooves of both bobbins, respectively.

3. The electromagnetic relay of claim 1, wherein both said bobbins are juxtaposed with their first and second flanges fixed together, respectively, by means of tabs and recesses of the bobbins engaging each other and interlocking means of the stationary contact elements engaging corresponding interlocking means provided on the respective bobbins.

4. The electromagnetic relay of claim 1, wherein said bobbins are identical in shape.

5. The electromagnetic relay of claim 4, wherein said bobbins have complementary tabs and recesses provided asymmetrically on their flanges.

6. The electromagnetic relay of claim 1, wherein said stationary contact elements have barb-like projections on both sides which are engaged with both bobbins, respectively.

7. The electromagnetic relay of claim 1, wherein both said bobbins are juxtaposed with their first and second flanges fixed together, respectively, each of said stationary contact elements has a contact arm and a terminal arm, said contact arms having barb-like projections on both sides which are engaged in each case with a first flange of each of said bobbins, respectively, said terminal arms extending along opposing peripheral sides of said boundary area and having grip means engaging corresponding pairs of interlocking means provided at peripheral regions of said second flanges of said bobbins.

8. An electromagnetic relay, comprising:

(a) a pair of first and second electromagnetic devices each of which comprises:

a bobbin carrying a coil and having first and second flanges at both ends thereof;

a core, a frame and an armature mounted rockably on said frame and having a movable end; and a contact spring actuated by said armature and having a contact end extending asymmetrically beyond said movable end of said armature, said pair of first and second bobbins are juxtaposed so as to define a boundary area therebetween, the first and second flanges of said bobbins being mounted contiguously together, respectively;

said first flanges of both the bobbins have first and second grooves, the first groove of the first bobbin being in alignment with the first groove of the second bobbin and the second groove of the first bobbin being in alignment with the second groove of the second bobbin; and (b) a pair of normally open and normally closed stationary contact elements which are arranged in said boundary area, said normally open stationary element having a contact arm being fitted into said first grooves of said first and second bobbins and a terminal arm extending along one side of the relay, said normally closed stationary element having a contact arm being fitted into said second grooves of said first and second bobbins and a connecting arm extending along the other side of the relay, said contact arms forming a contact gap, said movable end of said armatures opposing each other and said contact ends of the contact springs extending side by side in opposing directions into said contact gap, and each of said contact ends being reciprocated between said normally closed and said normally open stationary contact arms by activating said electromagnetic devices.

9. The electromagnetic relay of claim 8, wherein each of said first flanges of said first and second bobbins has a pair of first and second flange projections with said first and second grooves formed therein, the contact arms being fitted into said grooves of said first and second projections, respectively, and forming said contact gap in a section between said first and second projections, respectively, and said first and second contact arms have pairs of barb-like projections on both sides thereof, each of said barb-like projections engaging one of said flange projections of said first and second bobbins, respectively.

10. The electromagnetic relay of claim 9, wherein said barb-like projections are twisted.

11. The electromagnetic relay of claim 8, wherein said second flanges of said first and second bobbins each have an interlocking member provided on either peripheral side near said boundary area, said connecting arm of said normally open contact terminal has gripping means, engaging said interlocking members provided on a first peripheral side of said first and second bobbins and said connecting arm of said normally closed contact terminal has gripping means engaging said interlocking members provided on the other peripheral side of said first and second bobbins.

12. The electromagnetic relay of claim 8, further comprising a base receiving said pair of electromagnetic devices, and a cover mating with the base.

13. The electromagnetic relay of claim 1, wherein both said bobbins are juxtaposed with their first and second flanges fixed together, respectively, by means of tabs and recesses of the bobbins engaging each other.

14. The electromagnetic relay of claim 1, wherein both said bobbins are juxtaposed with their first and second flanges fixed together, respectively, by means of interlocking means of the stationary contact elements engaging corresponding interlocking means provided on the respective bobbins.

* * * * *